US011554584B2

(12) United States Patent
Naganuma et al.

(10) Patent No.: US 11,554,584 B2
(45) Date of Patent: Jan. 17, 2023

(54) LIQUID EJECTING HEAD AND LIQUID EJECTING APPARATUS

(71) Applicant: SEIKO EPSON CORPORATION, Tokyo (JP)

(72) Inventors: Yoichi Naganuma, Matsumoto (JP); Yuma Fukuzawa, Matsumoto (JP); Hitoshi Takaai, Azumino (JP); Shotaro Tamai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 43 days.

(21) Appl. No.: 17/160,449

(22) Filed: Jan. 28, 2021

(65) Prior Publication Data

US 2021/0237439 A1 Aug. 5, 2021

(30) Foreign Application Priority Data

Jan. 31, 2020 (JP) ..... JP2020-014627

(51) Int. Cl.
*B41J 2/045* (2006.01)
*B41J 2/14* (2006.01)
*B41J 2/18* (2006.01)

(52) U.S. Cl.
CPC ..... *B41J 2/04588* (2013.01); *B41J 2/04581* (2013.01); *B41J 2/14032* (2013.01); *B41J 2/14201* (2013.01); *B41J 2/18* (2013.01); *B41J 2202/12* (2013.01)

(58) Field of Classification Search
CPC ..... B41J 2/14233
See application file for complete search history.

(56) References Cited

U.S. PATENT DOCUMENTS

2002/0042993 A1* 4/2002 Umehara ..... B41J 2/1631 347/68
2006/0262167 A1* 11/2006 Sugahara ..... B41J 2/14233 347/68
2014/0362142 A1* 12/2014 Takaai ..... B41J 2/14201 347/71
2015/0028125 A1* 1/2015 Fukuda ..... B41J 2/14201 239/102.2
2017/0001442 A1 1/2017 Takabe et al.
2018/0201019 A1* 7/2018 Seto ..... B41J 2/14233
2020/0023647 A1* 1/2020 Hashimoto ..... B41J 29/38

FOREIGN PATENT DOCUMENTS

JP 2017-013390 A 1/2017
JP 2019147304 A * 9/2019 ..... B41J 2/14233
WO WO-2018116833 A1 * 6/2018 ..... B41J 2/01

* cited by examiner

*Primary Examiner* — Shelby L Fidler
(74) *Attorney, Agent, or Firm* — Workman Nydegger

(57) ABSTRACT a first sloped portion that is provided between the first wall surface and the third wall surface includes a first constituting surface that extends in a third direction between the first direction and the second direction.

17 Claims, 10 Drawing Sheets

LIQUID EJECTING HEAD AND LIQUID EJECTING APPARATUS

The present application is based on, and claims priority from JP Application Serial Number 2020-014627, filed Jan. 31, 2020, the disclosure of which is hereby incorporated by reference herein in its entirety.

BACKGROUND

1. Technical Field

Embodiments of the present disclosure relate to a liquid ejecting head and a liquid ejecting apparatus.

2. Related Art

A technique regarding a liquid ejecting head that ejects liquid in pressure compartments from nozzles is known in the art as disclosed in JP-A-2017-013390.

However, in the art, there is a risk that ejection abnormality, a phenomenon of having difficulty in ejecting liquid from a nozzle, might occur due to the presence of an air bubble staying in a flow passage leading from a pressure compartment to a nozzle.

SUMMARY

A liquid ejecting head according to a certain aspect of the present disclosure includes: a first pressure compartment that extends in a first direction and applies pressure to liquid; a second pressure compartment that extends in the first direction and applies pressure to liquid; a nozzle flow passage that extends in the first direction and is in communication with a nozzle from which liquid is ejected; a first communication flow passage that extends in a second direction intersecting with the first direction and provides communication between the first pressure compartment and the nozzle flow passage; a second communication flow passage that extends in the second direction and provides communication between the second pressure compartment and the nozzle flow passage; a supply flow passage from which liquid is supplied to the first pressure compartment; and a discharge flow passage to which liquid is discharged from the second pressure compartment; wherein wall surfaces of the second pressure compartment include a first wall surface that extends in the first direction and is most distant from the nozzle in the second direction, wall surfaces of the second communication flow passage include a second wall surface that extends in the second direction and is most distant from the nozzle in the first direction and a third wall surface that is opposite of the second wall surface in the first direction, a first sloped portion is provided between the first wall surface and the third wall surface, and the first sloped portion includes a first constituting surface that extends in a third direction between the first direction and the second direction.

A liquid ejecting apparatus according to a certain aspect of the present disclosure includes: a first pressure compartment that extends in a first direction and applies pressure to liquid; a second pressure compartment that extends in the first direction and applies pressure to liquid; a nozzle flow passage that extends in the first direction and is in communication with a nozzle from which liquid is ejected; a first communication flow passage that extends in a second direction intersecting with the first direction and provides communication between the first pressure compartment and the nozzle flow passage; a second communication flow passage that extends in the second direction and provides communication between the second pressure compartment and the nozzle flow passage; a supply flow passage from which liquid is supplied to the first pressure compartment; and a discharge flow passage to which liquid is discharged from the second pressure compartment; wherein wall surfaces of the second pressure compartment include a first wall surface that extends in the first direction and is most distant from the nozzle in the second direction, wall surfaces of the second communication flow passage include a second wall surface that extends in the second direction and is most distant from the nozzle in the first direction and a third wall surface that is opposite of the second wall surface in the first direction, a first sloped portion is provided between the first wall surface and the third wall surface, and the first sloped portion includes a first constituting surface that extends in a third direction between the first direction and the second direction.

DESCRIPTION OF EXEMPLARY EMBODIMENTS

Figure 1:
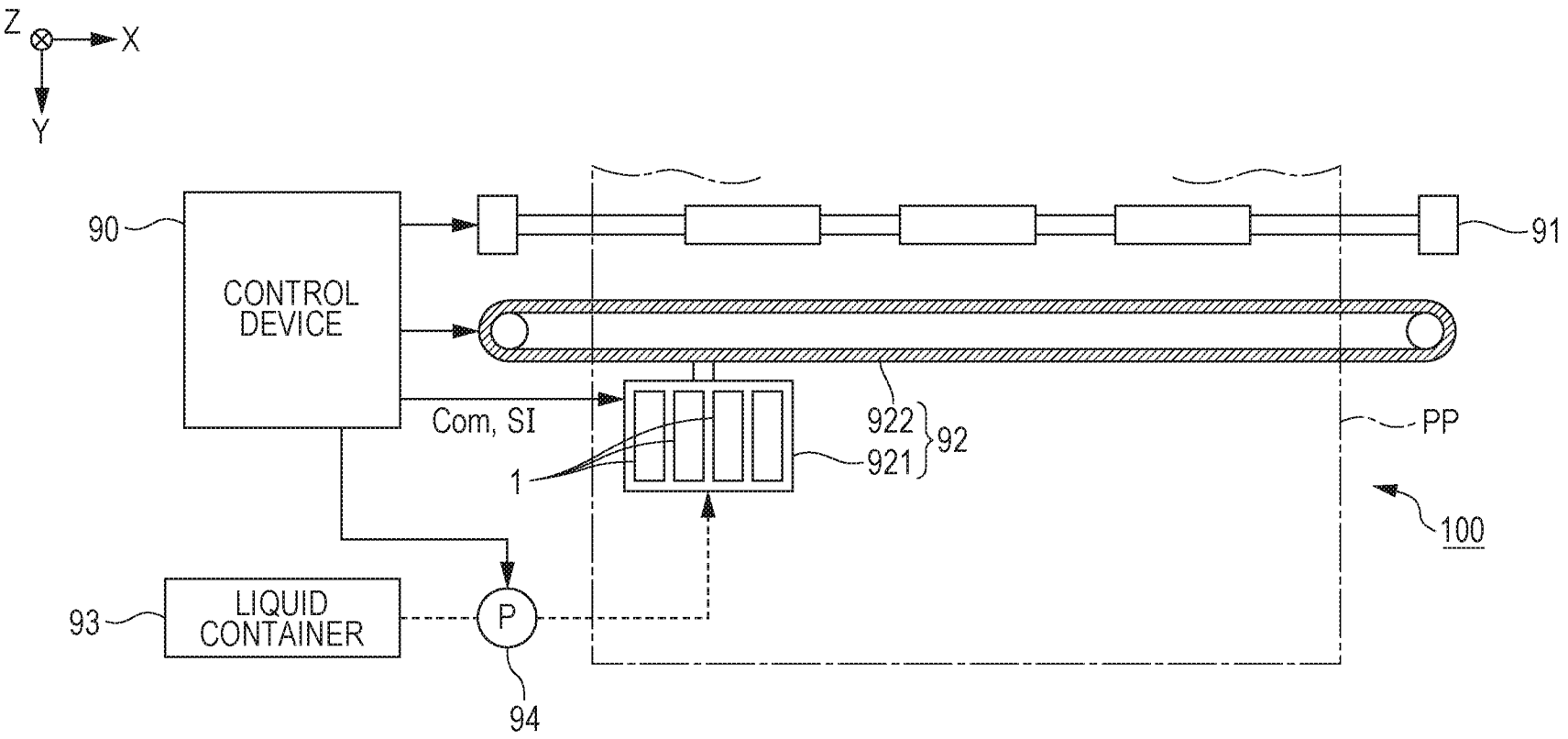
FIG. 1 is a diagram that illustrates an example of the structure of a liquid ejecting apparatus 100 according to an exemplary embodiment of the present disclosure.

With reference to the accompanying drawings, an exemplary embodiment of the present disclosure will now be explained. In the drawings, however, the dimensions and scales of components may be made different as needed from those in actual implementation. Since the embodiment described below shows some preferred examples of the present disclosure, they contain various technically-preferred limitations. However, the scope of the present disclosure is not limited to the examples described below unless any intention of restriction is mentioned explicitly.

A. Exemplary Embodiment

With reference to FIG. 1, a liquid ejecting apparatus 100 according to a present embodiment will now be explained.

1. Overview of Liquid Ejecting Apparatus

FIG. 1 is a diagram for explaining an example of the liquid ejecting apparatus 100 according to the present embodiment. The liquid ejecting apparatus 100 according to the present embodiment is an ink-jet printing apparatus that ejects ink onto a medium PP. An example of the medium PP is printing paper, but not limited thereto. Any target of printing such as a resin film or a cloth can be used as the medium PP. As illustrated in FIG. 1, the liquid ejecting apparatus 100 includes a liquid container 93, which contains ink. For example, a cartridge that can be detachably attached to the liquid ejecting apparatus 100, a bag-type ink pack made of a flexible film material, an ink tank from which ink can be supplied for replenishment, etc. may be used as the liquid container 93. Various kinds of ink different from one another in terms of colors are contained in the liquid container 93.

As illustrated in FIG. 1, the liquid ejecting apparatus 100 includes a control device 90, a moving mechanism 91, a traveling mechanism 92, and a circulation mechanism 94. Among them, the control device 90 includes, for example, a processing circuit such as a CPU or an FPGA, and a storage circuit such as a semiconductor memory, and controls various elements of the liquid ejecting apparatus 100. CPU is an abbreviation for Central Processing Unit. FPGA is an abbreviation for Field Programmable Gate Array. Under the control of the control device 90, the moving mechanism 91 transports the medium PP in a +Y direction. In the description below, the +Y direction and the −Y direction, which is the opposite of the +Y direction, are collectively referred to as "Y-axis direction". Under the control of the control device 90, the traveling mechanism 92 reciprocates a plurality of liquid ejecting heads 1 in a +X direction and a −X direction, which is the opposite of the +X direction. In the description below, the +X direction and the −X direction are collectively referred to as "X-axis direction". The +X direction is a direction intersecting with the +Y direction. For example, the +X direction is a direction orthogonal to the +Y direction. The traveling mechanism 92 includes a housing case 921, in which the plurality of liquid ejecting heads 1 is encased, and an endless belt 922, to which the housing case 921 is fixed. The liquid container 93 and the circulation mechanism 94 may be encased together with the liquid ejecting heads 1 in the housing case 921. Under the control of the control device 90, the circulation mechanism 94 supplies ink contained in the liquid container 93 to a supply flow passage RB1 provided in the liquid ejecting head 1. Moreover, under the control of the control device 90, the circulation mechanism 94 collects ink from a discharge flow passage RB2 provided in the liquid ejecting head 1, and causes the collected ink to flow back into the supply flow passage RB1. The supply flow passage RB1 and the discharge flow passage RB2 will be described later with reference to FIG. 3.

As illustrated in FIG. 1, a drive signal Com for driving the liquid ejecting head 1 and a control signal SI for controlling the liquid ejecting head 1 are supplied from the control device 90 to the liquid ejecting head 1. The liquid ejecting head 1 is driven by the drive signal Com under the control of the control signal SI, and ink is ejected in a +Z direction from a part or all of a plurality of nozzles N provided in the liquid ejecting head 1, wherein the number of the nozzles N is denoted as M. The value M is a natural number that is greater than one. The +Z direction is a direction intersecting with the +X direction and the +Y direction. For example, the +Z direction is a direction orthogonal to the +X direction and the +Y direction. In the description below, the +Z direction and the −Z direction, which is the opposite of the +Z direction, may be collectively referred to as "Z-axis direction". The nozzles N will be described later with reference to FIGS. 2 to 4. Linked with the transportation of the medium PP by the moving mechanism 91 and the reciprocation of the liquid ejecting head 1 by the traveling mechanism 92, the liquid ejecting head 1 ejects ink droplets from a part or all of the plurality M of nozzles N such that the ejected ink droplets will land onto the surface of the medium PP, thereby forming a print-demanded image on the surface of the medium PP.

2. Overview of Liquid Ejecting Head

Figure 2:
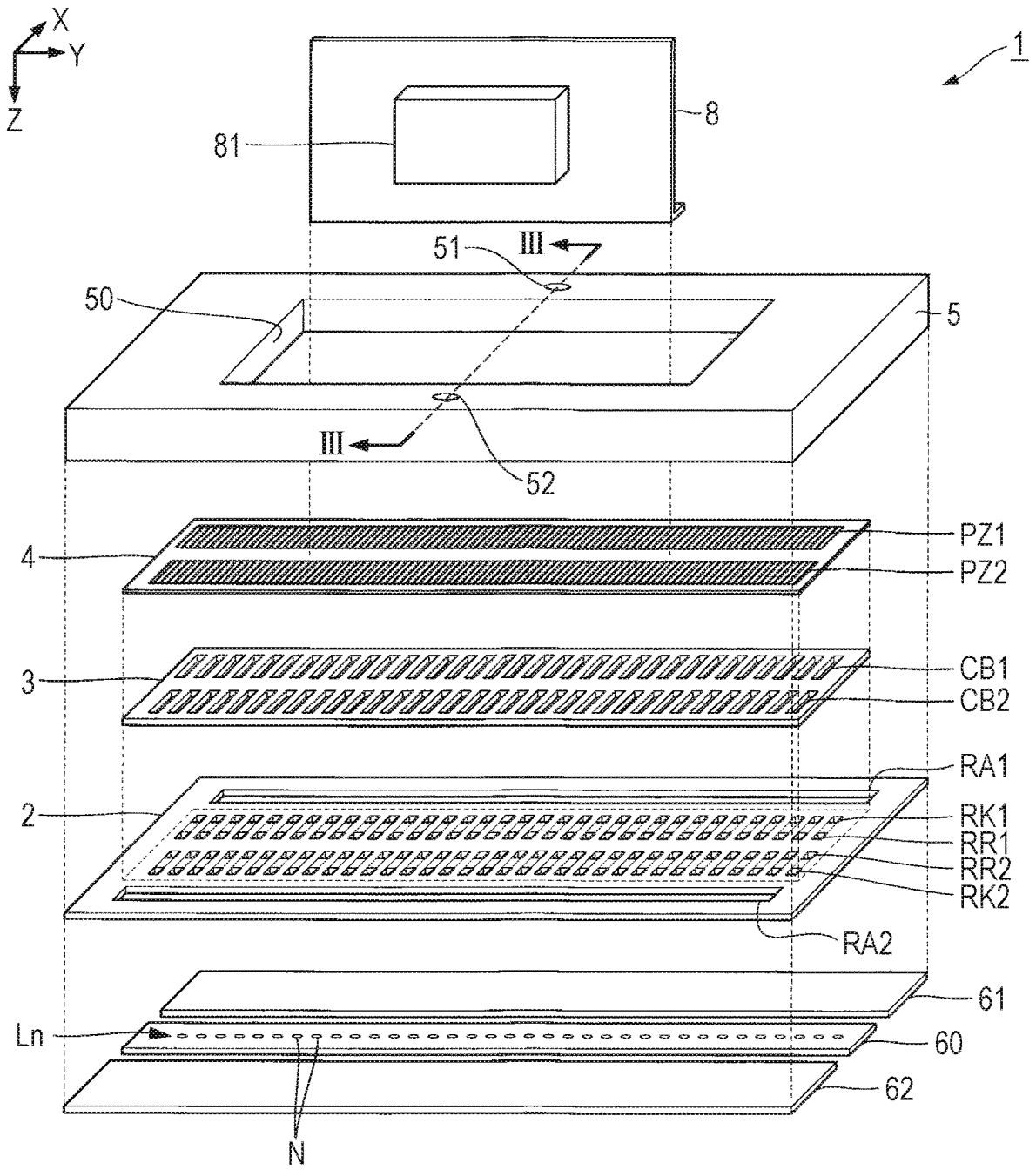
FIG. 2 is an exploded perspective view of an example of the structure of a liquid ejecting head 1.
Figure 3:
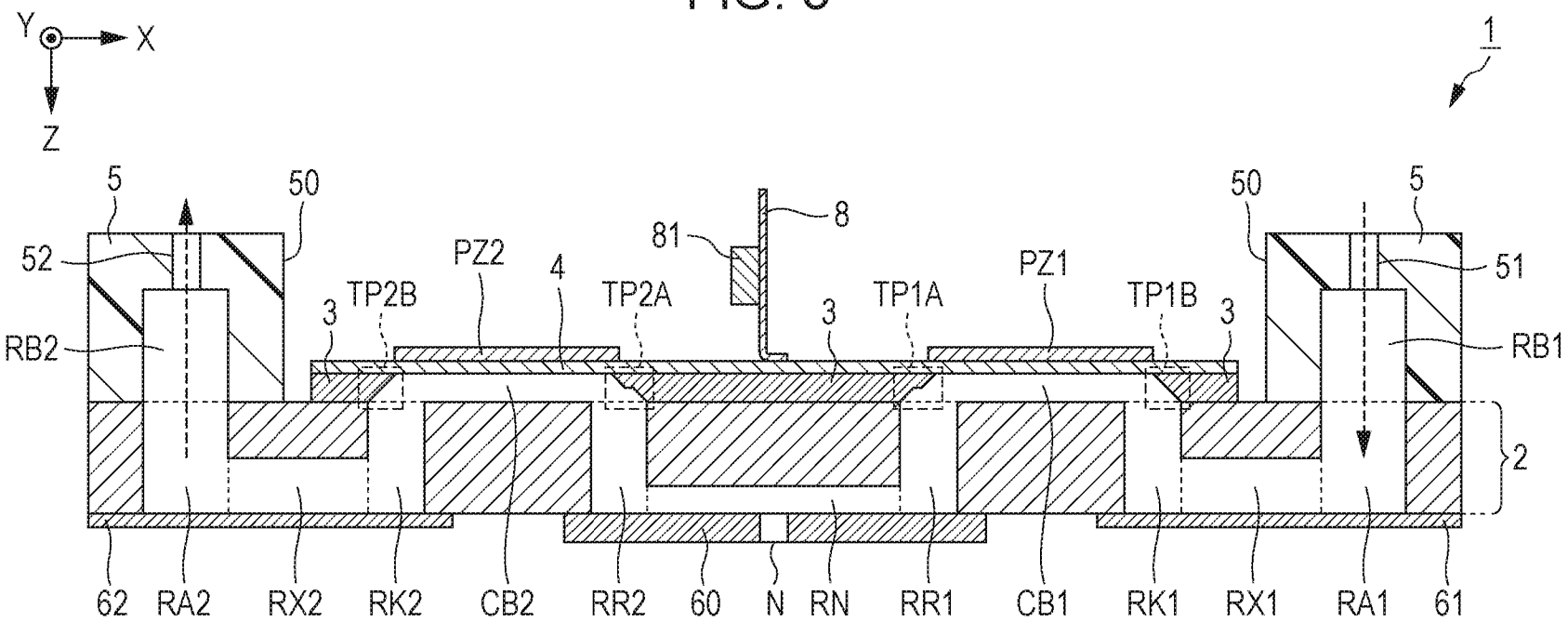
FIG. 3 is a sectional view of an example of the structure of the liquid ejecting head 1.
Figure 4:
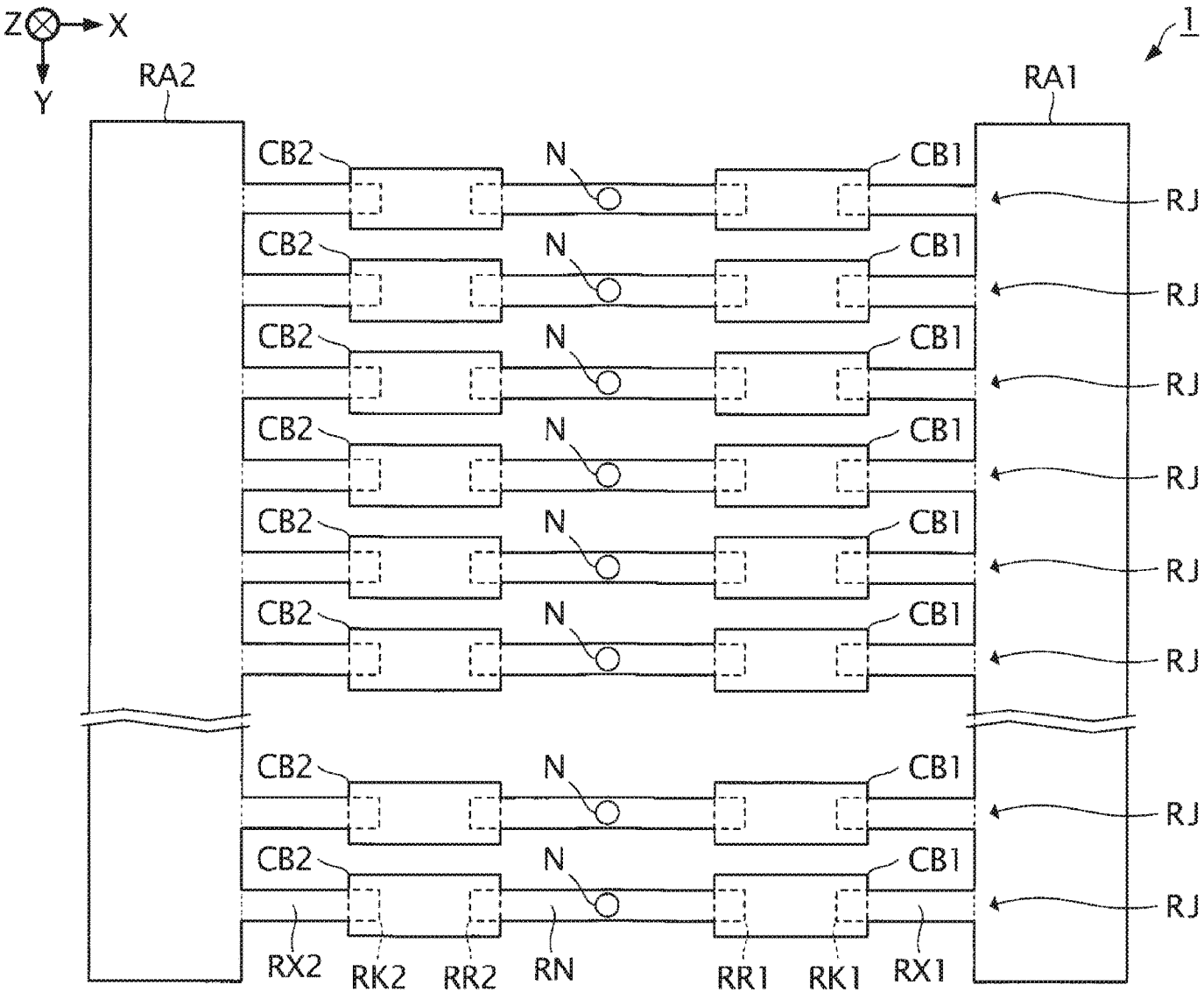
FIG. 4 is a plan view of an example of the structure of the liquid ejecting head 1.

With reference to FIGS. 2 to 5, an overview of the liquid ejecting head 1 is given below. FIG. 2 is an exploded perspective view of the liquid ejecting head 1. FIG. 3 is a sectional view taken along the line III-III of FIG. 2. FIG. 4 is a plan view of the liquid ejecting head 1, taken from the −Z direction.

As illustrated in FIGS. 2 and 3, the liquid ejecting head 1 includes a nozzle substrate 60, a compliance sheet 61, a compliance sheet 62, a communication plate 2, a pressure compartment substrate 3, a vibrating plate 4, a reservoir forming substrate 5, and a wiring substrate 8.

As illustrated in FIG. 2, the nozzle substrate 60 is a plate-like member that is elongated in the Y-axis direction and extends substantially in parallel with an X-Y plane. The concept of "substantially in parallel with" herein includes not only a case of being perfectly in parallel but also a case of being able to be deemed as parallel, with a margin of error taken into consideration. The nozzle substrate 60 is manufactured by, for example, processing a monocrystalline silicon substrate by using a semiconductor manufacturing technology such as etching. However, known materials and methods can be used for manufacturing the nozzle substrate 60. The nozzle N is a through hole provided in the nozzle substrate 60. In the present embodiment, as an example, it is assumed that the plurality M of nozzles N is provided in the nozzle substrate 60 to constitute a nozzle line Ln extending in the Y-axis direction.

As illustrated in FIGS. 2 and 3, the communication plate 2 is provided on the −Z side with respect to the nozzle substrate 60. The communication plate 2 is a plate-like member that is elongated in the Y-axis direction and extends substantially in parallel with an X-Y plane. Passages through which ink flows are formed in the communication plate 2. Specifically, one supply flow passage RA1 and one discharge flow passage RA2 are formed in the communication plate 2. The supply flow passage RA1 is in communication with the supply flow passage RB1, which will be described later, and extends in the Y-axis direction. The discharge flow passage RA2 is in communication with the discharge flow passage RB2, which will be described later, and is provided on the −X side as viewed from the supply flow passage RA1 in such a way as to extend in the Y-axis direction. The following flow passages are formed in the communication plate 2: a plurality M of nozzle flow passages RN having one-to-one correspondence to the plurality M of nozzles N, a plurality M of communication flow passages RR1 having one-to-one correspondence to the plurality M of nozzles N, a plurality M of communication flow passages RR2 having one-to-one correspondence to the plurality M of nozzles N, a plurality M of communication flow passages RK1 having one-to-one correspondence to the plurality M of nozzles N, a plurality M of communication flow passages RK2 having one-to-one correspondence to the plurality M of nozzles N, a plurality M of communication flow passages RX1 having one-to-one correspondence to the plurality M of nozzles N, and a plurality M of communication flow passages RX2 having one-to-one correspondence to the plurality M of nozzles N. A single communication flow passages RX1 that is common to the plurality M of nozzles N and a single communication flow passages RX2 that is common to the plurality M of nozzles N may be provided in the communication plate 2. The communication flow passage RX1 is in communication with the supply flow passage RA1 and is provided on the −X side as viewed from the supply flow passage RA1 in such a way as to extend in the X-axis direction. The communication flow passage RK1 is in communication with the communication flow passage RX1 and is provided on the −X side as viewed from the communication flow passage RX1 in such a way as to extend in the Z-axis direction. The communication flow passage RR1 is provided on the −X side as viewed from the communication flow passage RK1 in such a way as to extend in the Z-axis direction. The communication flow passage RX2 is in communication with the discharge flow passage RA2 and is provided on the +X side as viewed from the discharge flow passage RA2 in such a way as to extend in the X-axis direction. The communication flow passage RK2 is in communication with the communication flow passage RX2 and is provided on the +X side as viewed from the communication flow passage RX2 in such a way as to extend in the Z-axis direction. The communication flow passage RR2 is provided on the +X side as viewed from the communication flow passage RK2 and on the −X side as viewed from the communication flow passage RR1 in such a way as to extend in the Z-axis direction. The nozzle flow passage RN provides communication between the communication flow passage RR1 and the communication flow passage RR2 and is provided on the −X side as viewed from the communication flow passage RR1 and on the +X side as viewed from the communication flow passage RR2 in such a way as to extend in the X-axis direction. The nozzle flow passage RN is in communication with the nozzle N corresponding to this nozzle flow passage RN. The communication plate 2 is manufactured by, for example, processing a monocrystalline silicon substrate by using a semiconductor manufacturing technology. However, known materials and methods can be used for manufacturing the communication plate 2.

As illustrated in FIGS. 2 and 3, the pressure compartment substrate 3 is provided on the −Z side with respect to the communication plate 2. The pressure compartment substrate 3 is a plate-like member that is elongated in the Y-axis direction and extends substantially in parallel with an X-Y plane. Passages through which ink flows are formed in the pressure compartment substrate 3. Specifically, a plurality M of pressure compartments CB1 having one-to-one correspondence to the plurality M of nozzles N and a plurality M of pressure compartments CB2 having one-to-one correspondence to the plurality M of nozzles N are formed in the pressure compartment substrate 3. The pressure compartment CB1 provides communication between the communication flow passage RK1 and the communication flow passage RR1 and is provided in such a way as to, when viewed in the Z-axis direction, connect the +X-side end of the communication flow passage RK1 and the −X-side end of the communication flow passage RR1 and extend in the X-axis direction. The pressure compartment CB2 provides communication between the communication flow passage RK2 and the communication flow passage RR2 and is provided in such a way as to, when viewed in the Z-axis direction, connect the −X-side end of the communication flow passage RK2 and the +X-side end of the communication flow passage RR2 and extend in the X-axis direction. The pressure compartment substrate 3 is manufactured by, for example, processing a monocrystalline silicon substrate by using a semiconductor manufacturing technology. However, known materials and methods can be used for manufacturing the pressure compartment substrate 3. As will be described in detail later, in the pressure compartment substrate 3, a sloped portion TP1A and a sloped portion TP1B are provided to correspond to the pressure compartment CB1, and a sloped portion TP2A and a sloped portion TP2B are provided to correspond to the pressure compartment CB2.

In the description below, an ink flow passage providing communication between the supply flow passage RA1 and the discharge flow passage RA2 is referred to as a circulation flow passage RJ. As illustrated in FIG. 4, communication between the supply flow passage RA1 and the discharge flow passage RA2 is provided by a plurality M of circulation flow passages RJ having one-to-one correspondence to the plurality M of nozzles N. As mentioned above, each circulation flow passage RJ includes the communication flow passage RX1 communicating with the supply flow passage RA1, the communication flow passage RK1 communicating with the communication flow passage RX1, the pressure compartment CB1 communicating with the communication flow passage RK1, the communication flow passage RR1 communicating with the pressure compartment CB1, the nozzle flow passage RN communicating with the communication flow passage RR1, the communication flow passage RR2 communicating with the nozzle flow passage RN, the pressure compartment CB2 communicating with the communication flow passage RR2, the communication flow passage RK2 communicating with the pressure compartment CB2, and the communication flow passage RX2 providing communication between the communication flow passage RK2 and the discharge flow passage RA2. In the present embodiment, as an example, it is assumed that each circulation flow passage RJ extends in the X-axis direction.

As illustrated in FIGS. 2 and 3, the vibrating plate 4 is provided on the −Z side with respect to the pressure compartment substrate 3. The vibrating plate 4 is a plate-like member that is elongated in the Y-axis direction and extends substantially in parallel with an X-Y plane. The vibrating plate 4 is a member that is able to vibrate elastically.

As illustrated in FIGS. 2 and 3, a plurality M of piezoelectric elements PZ1 having one-to-one correspondence to the plurality M of pressure compartments CB1 and a plurality M of piezoelectric elements PZ2 having one-to-one correspondence to the plurality M of pressure compartments CB2 are provided on the −Z surface of the vibrating plate 4. In the description below, the piezoelectric element PZ1 and the piezoelectric element PZ2 are collectively referred to as "piezoelectric element PZq". The piezoelectric element PZq is a passive element that deforms in response to a change in the voltage level of the drive signal Com. In other words, the piezoelectric element PZq is an example of an energy conversion element that converts the electric energy of the drive signal Com into motion energy. In the description below, a suffix "q" may be added to reference signs that represent components or signals corresponding to the piezoelectric element PZq.

Figure 5:
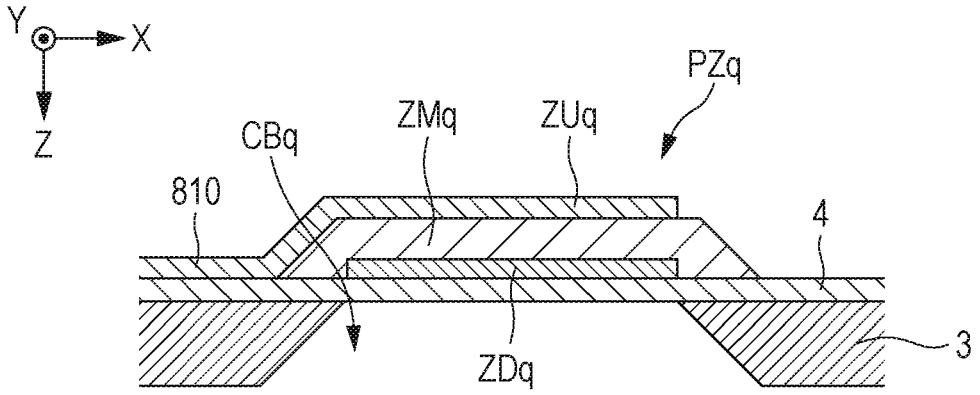
FIG. 5 is a sectional view of an example of the structure of a piezoelectric element PZq.

FIG. 5 is an enlarged sectional view of the piezoelectric element PZq, including its neighborhood. As illustrated in FIG. 5, the piezoelectric element PZq has a layered structure in which a piezoelectric material ZMq is sandwiched between a lower electrode ZDq and an upper electrode ZUq. A predetermined reference voltage level signal VBS is supplied to the lower electrode ZDq. The drive signal Com is supplied to the upper electrode ZUq. The piezoelectric element PZq is a portion where the lower electrode ZDq, the upper electrode ZUq, and the piezoelectric material ZMq overlap with one another when viewed in the −Z direction, for example. A pressure compartment CBq is provided on the +Z side with respect to the piezoelectric element PZq. As mentioned above, the piezoelectric element PZq is driven to deform in response to a change in the voltage level of the drive signal Com. The vibrating plate 4 vibrates by being driven by the deformation of the piezoelectric element PZq. The vibration of the vibrating plate 4 causes changes in pressure inside the pressure compartment CBq. Because of the changes in pressure inside the pressure compartment CBq, ink with which the inside of the pressure compartment CBq is filled flows through the communication flow passage RRq and the nozzle flow passage RN to be ejected from the nozzle N.

As illustrated in FIGS. 2 and 3, the wiring substrate 8 is mounted on the −Z surface of the vibrating plate 4. The wiring substrate 8 is a component that provides electric connection between the control device 90 and the liquid ejecting head 1. For example, a flexible wiring board such as FPC or FFC can be preferably used as the wiring substrate 8. FPC is an abbreviation for Flexible Printed Circuit. FFC is an abbreviation for Flexible Flat Cable. A drive circuit 81 is mounted on the wiring substrate 8. The drive circuit 81 is an electric circuit that performs switching as to whether or not to supply the drive signal Com to the piezoelectric element PZq under the control of the control signal SI. As illustrated in FIG. 5, the drive circuit 81 supplies the drive signal Com via a wiring line 810 to the upper electrode ZUq of the piezoelectric element PZq. In the description below, the drive signal Com supplied to the piezoelectric element PZ1 may be referred to as "drive signal Com1", and the drive signal Com supplied to the piezoelectric element PZ2 may be referred to as "drive signal Com2". In the present embodiment, it is assumed that the waveform of the drive signal Com1 that is supplied to the piezoelectric element PZ1 corresponding to the nozzle N by the drive circuit 81 when ink is to be ejected from the nozzle N is substantially the same as the waveform of the drive signal Com2 that is supplied to the piezoelectric element PZ2 corresponding to the nozzle N by the drive circuit 81. The concept of "substantially the same" herein includes not only a case of being perfectly the same but also a case of being able to be deemed as the same, with a margin of error taken into consideration.

As illustrated in FIGS. 2 and 3, the reservoir forming substrate 5 is provided on the −Z side with respect to the vibrating plate 4. The reservoir forming substrate 5 is a member that is elongated in the Y-axis direction. Passages through which ink flows are formed in the reservoir forming substrate 5. Specifically, one supply flow passage RB1 and one discharge flow passage RB2 are formed in the reservoir forming substrate 5. The supply flow passage RB1 is in communication with the supply flow passage RA1 and is provided on the −Z side as viewed from the supply flow passage RA1 in such a way as to extend in the Y-axis direction. The discharge flow passage RB2 is in communication with the discharge flow passage RA2 and is provided on the −Z side as viewed from the discharge flow passage RA2 and on the −X side as viewed from the supply flow passage RB1 in such a way as to extend in the Y-axis direction. A feed inlet 51, which is in communication with the supply flow passage RB1, and a discharge outlet 52, which is in communication with the discharge flow passage RB2, are provided in the reservoir forming substrate 5. Ink is supplied from the liquid container 93 into the supply flow passage RB1 through the feed inlet 51. Ink is collected from the discharge flow passage RB2 through the discharge outlet 52. The reservoir forming substrate 5 has an opening 50. The pressure compartment substrate 3, the vibrating plate 4, and the wiring substrate 8 are provided inside the opening 50. The reservoir forming substrate 5 is formed by, for example, injection molding of a resin material. However, known materials and methods can be used for manufacturing the reservoir forming substrate 5.

In the present embodiment, ink supplied to the feed inlet 51 from the liquid container 93 flows through the supply flow passage RB1 into the supply flow passage RA1. Then, a part of the ink that has flowed into the supply flow passage RA1 flows through the communication flow passage RX1 and the communication flow passage RK1 into the pressure compartment CB1. A part of the ink that has flowed into the pressure compartment CB1 flows through the communication flow passage RR1, the nozzle flow passage RN, and the communication flow passage RR2 into the pressure compartment CB2. Then, a part of the ink that has flowed into the pressure compartment CB2 flows through the communication flow passage RK2, the communication flow passage RX2, the discharge flow passage RA2, and the discharge flow passage RB2 to be discharged through the discharge outlet 52. When the piezoelectric element PZ1 is driven by the drive signal Com1, a part of ink with which the inside of the pressure compartment CB1 is filled flows through the communication flow passage RR1 and the nozzle flow passage RN to be ejected from the nozzle N. When the piezoelectric element PZ2 is driven by the drive signal Com2, a part of ink with which the inside of the pressure compartment CB2 is filled flows through the communication flow passage RR2 and the nozzle flow passage RN to be ejected from the nozzle N.

As illustrated in FIGS. 2 and 3, the compliance sheet 61 is provided on the +Z surface of the communication plate 2 in such a way as to hermetically close the supply flow passage RA1, the communication flow passage RX1, and the communication flow passage RK1. The compliance sheet 61 is made of an elastic material. The compliance sheet 61 absorbs the pressure fluctuations of ink inside the supply flow passage RA1, the communication flow passage RX1, and the communication flow passage RK1. The compliance sheet 62 is provided on the +Z surface of the communication plate 2 in such a way as to hermetically close the discharge flow passage RA2, the communication flow passage RX2, and the communication flow passage RK2. The compliance sheet 62 is made of an elastic material. The compliance sheet 62 absorbs the pressure fluctuations of ink inside the discharge flow passage RA2, the communication flow passage RX2, and the communication flow passage RK2.

As explained above, in the liquid ejecting head 1 according to the present embodiment, ink is circulated from the supply flow passage RA1 to the discharge flow passage RA2 through the circulation flow passage RJ. For this reason, in the present embodiment, even if there is a period during which no ink inside the pressure compartment CBq is ejected from the nozzle N, it is possible to prevent the ink from remaining stayed inside the pressure compartment CBq, the nozzle flow passage RN, etc. Therefore, in the present embodiment, even if there is a period during which no ink inside the pressure compartment CBq is ejected from the nozzle N, it is possible to prevent the viscosity of the ink inside the pressure compartment CBq from increasing. This makes it possible to prevent the occurrence of ejection abnormality in which it is impossible to perform ejection from the nozzle N properly due to the increased viscosity of the ink.

The liquid ejecting head 1 according to the present embodiment is able to eject ink contained inside the pressure compartment CB1 and is able to eject ink contained inside the pressure compartment CB2, from the nozzle N. For this reason, for example, as compared with an embodiment in which ink contained inside a single pressure compartment CBq only is ejected from the nozzle N, it is possible to increase the amount of ink ejected from the nozzle N.

3. Shape of Pressure Compartment

Figure 6:
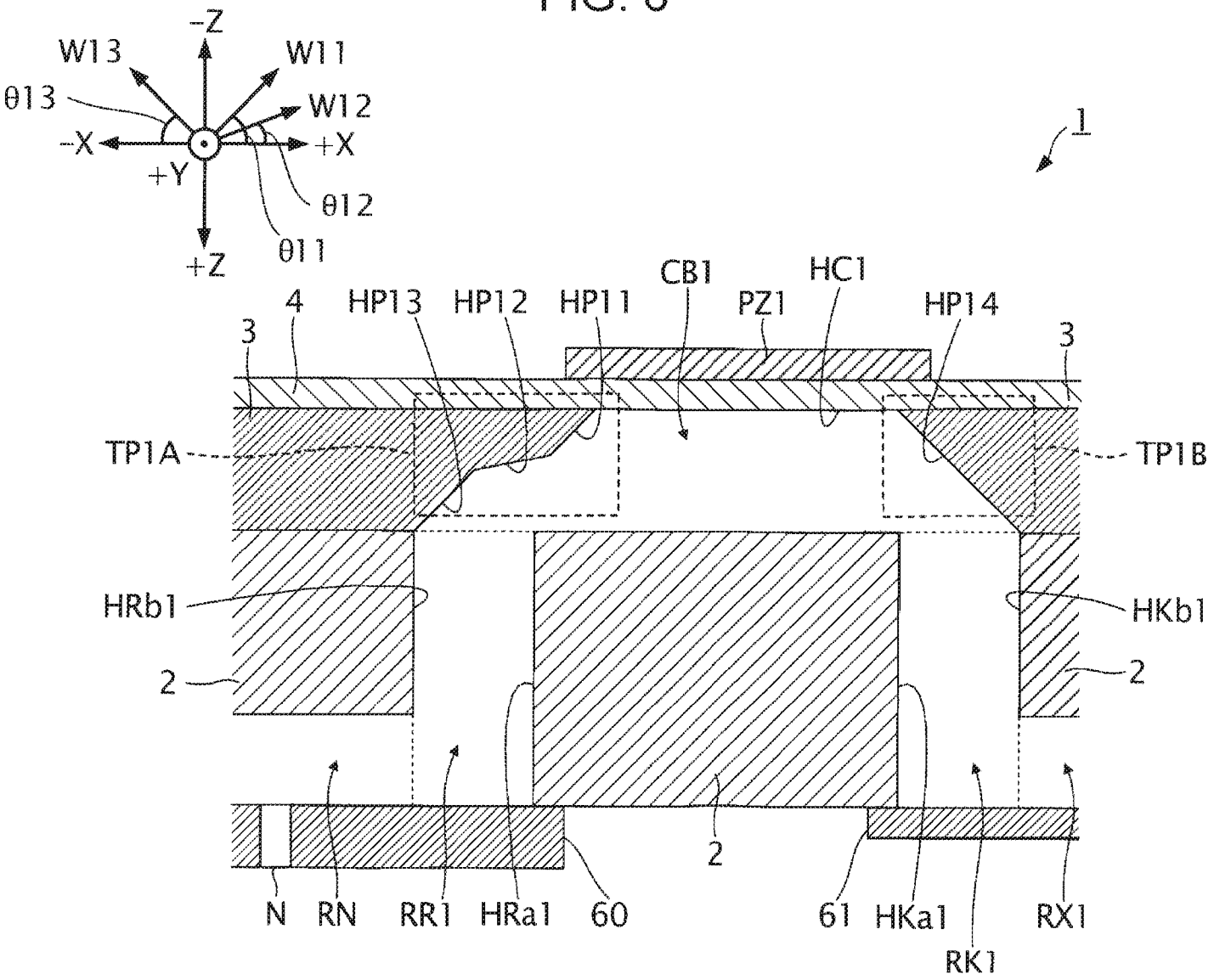
FIG. 6 is a sectional view of an example of the structure of the liquid ejecting head 1.
Figure 7:
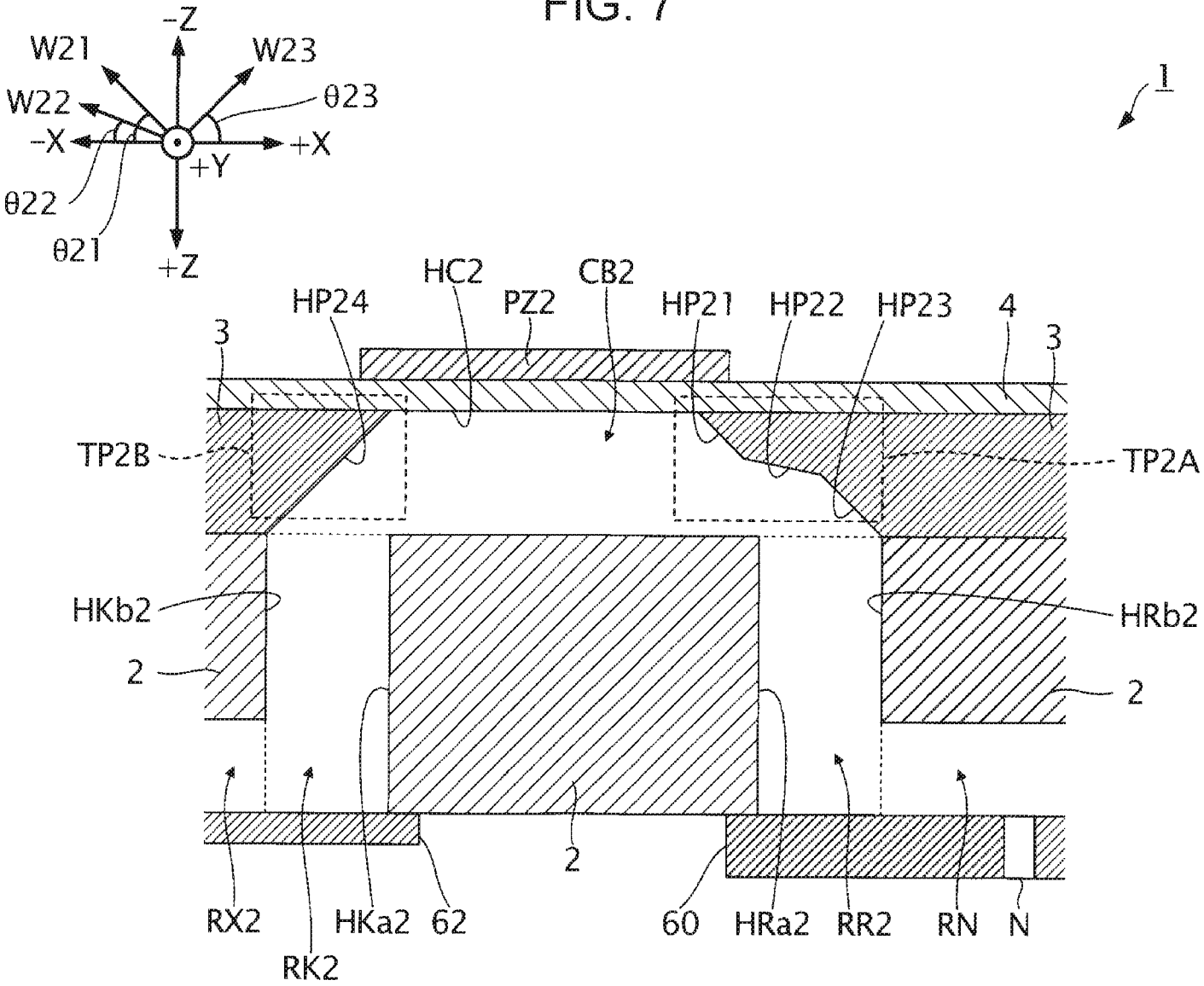
FIG. 7 is a sectional view of an example of the structure of the liquid ejecting head 1.

With reference to FIGS. 6 and 7, the shape of the pressure compartment CBq will now be explained.

FIG. 6 is a sectional view of the nozzle flow passage RN, the communication flow passage RR1, the pressure compartment CB1, the communication flow passage RK1, and the communication flow passage RX1 among those constituting the circulation flow passage RJ. As illustrated in FIG. 6, the communication flow passage RR1 has a +X wall surface HRa1 and a −X wall surface HRb1 when viewed in the Y-axis direction. Among wall surfaces that constitute the communication flow passage RR1, the wall surface HRal is most distant from the nozzle N in the X-axis direction. When viewed in the Y-axis direction, the wall surface HRa1 extends in the Z-axis direction. In the present embodiment, "the distance between one object and another object" means the shortest distance between said one object and said another object. The wall surface HRb1, which is one of two wall surfaces that constitute the communication flow passage RR1 and extend in the Z-axis direction when viewed in the Y-axis direction, is the opposite of the wall surface HRal. The communication flow passage RK1 has a −X wall surface HKa1 and a +X wall surface HKb1 when viewed in the Y-axis direction. Among wall surfaces that constitute the communication flow passage RK1, the wall surface HKb1 is most distant from the nozzle N in the X-axis direction. When viewed in the Y-axis direction, the wall surface HKb1 extends in the Z-axis direction. The wall surface HKa1, which is one of two wall surfaces that constitute the communication flow passage RK1 and extend in the Z-axis direction when viewed in the Y-axis direction, is the opposite of the wall surface HKb1. The pressure compartment CB1 has a wall surface HC1 when viewed in the Y-axis direction. Among wall surfaces that constitute the pressure compartment CB1, the wall surface HC1 is most distant from the nozzle N in the Z-axis direction. When viewed in the Y-axis direction, the wall surface HC1 extends in the X-axis direction.

As illustrated in FIG. 6, the sloped portion TP1A is provided between the wall surface HRb1 and the wall surface HC1 in the pressure compartment substrate 3. The sloped portion TP1A has a wall surface HP11, a wall surface HP12, and wall surface HP13. Among these wall surfaces, when viewed in the Y-axis direction, the wall surface HP11 extends in a W11 direction and is continuous to the wall surface HC1. The W11 direction is a direction between the +X direction and the −Z direction. Specifically, the W11 direction is a direction obtained by rotating the +X direction counterclockwise by an angle θ11 when viewed in the +Y direction. The angle θ11 is an angle that is greater than 0° and less than 90°, preferably, greater than 30° and less than 60°. When viewed in the Y-axis direction, the wall surface HP13 extends in the W11 direction and is continuous from the wall surface HRb1. When viewed in the Y-axis direction, the wall surface HP12 extends in a W12 direction and is continuous from the wall surface HP13 to the wall surface HP11. The W12 direction is a direction between the +X direction and the W11 direction. Specifically, the W12 direction is a direction obtained by rotating the +X direction counterclockwise by an angle θ12 when viewed in the +Y direction. The angle θ12 is an angle that is greater than 0° and less than the angle θ11. The wall surface HP12 may extend in the +X direction when viewed in the Y-axis direction.

As illustrated in FIG. 6, the sloped portion TP1B is provided between the wall surface HKb1 and the wall surface HC1 in the pressure compartment substrate 3. The sloped portion TP1B has a wall surface HP14. When viewed in the Y-axis direction, the wall surface HP14 extends in a W13 direction and is continuous from the wall surface HKb1 to the wall surface HC1. The W13 direction is a direction between the −X direction and the −Z direction. Specifically, the W13 direction is a direction obtained by rotating the −X direction clockwise by an angle θ13 when viewed in the +Y direction. The angle θ13 is an angle that is greater than 0° and less than 90°, preferably, greater than 30° and less than 60°. For example, the angle θ13 may be substantially the same as the angle θ11.

FIG. 7 is a sectional view of the nozzle flow passage RN, the communication flow passage RR2, the pressure compartment CB2, the communication flow passage RK2, and the communication flow passage RX2 among those constituting the circulation flow passage RJ. As illustrated in FIG. 7, the communication flow passage RR2 has a −X wall surface HRa2 and a +X wall surface HRb2 when viewed in the Y-axis direction. Among wall surfaces that constitute the communication flow passage RR2, the wall surface HRa2 is most distant from the nozzle N in the X-axis direction. When viewed in the Y-axis direction, the wall surface HRa2 extends in the Z-axis direction. The wall surface HRb2, which is one of two wall surfaces that constitute the communication flow passage RR2 and extend in the Z-axis direction when viewed in the Y-axis direction, is the opposite of the wall surface HRa2. The communication flow passage RK2 has a +X wall surface HKa2 and a −X wall surface HKb2 when viewed in the Y-axis direction. Among wall surfaces that constitute the communication flow passage RK2, the wall surface HKb2 is most distant from the nozzle N in the X-axis direction. When viewed in the Y-axis direction, the wall surface HKb2 extends in the Z-axis direction. The wall surface HKa2, which is one of two wall surfaces that constitute the communication flow passage RK2 and extend in the Z-axis direction when viewed in the Y-axis direction, is the opposite of the wall surface HKb2. The pressure compartment CB2 has a wall surface HC2 when viewed in the Y-axis direction. Among wall surfaces that constitute the pressure compartment CB2, the wall surface HC2 is most distant from the nozzle N in the Z-axis direction. When viewed in the Y-axis direction, the wall surface HC2 extends in the X-axis direction.

As illustrated in FIG. 7, the sloped portion TP2A is provided between the wall surface HRb2 and the wall surface HC2 in the pressure compartment substrate 3. The sloped portion TP2A has a wall surface HP21, a wall surface HP22, and wall surface HP23. Among these wall surfaces, when viewed in the Y-axis direction, the wall surface HP21 extends in a W21 direction and is continuous to the wall surface HC2. The W21 direction is a direction between the −X direction and the −Z direction. Specifically, the W21 direction is a direction obtained by rotating the −X direction clockwise by an angle θ21 when viewed in the +Y direction. The angle θ21 is an angle that is greater than 0° and less than 90°, preferably, greater than 30° and less than 60°. For example, the angle θ21 may be substantially the same as the angle θ11. When viewed in the Y-axis direction, the wall surface HP23 extends in the W21 direction and is continuous from the wall surface HRb2. When viewed in the Y-axis direction, the wall surface HP22 extends in a W22 direction and is continuous from the wall surface HP23 to the wall surface HP21. The W22 direction is a direction between the −X direction and the W21 direction. Specifically, the W22 direction is a direction obtained by rotating the −X direction clockwise by an angle θ22 when viewed in the +Y direction. The angle θ22 is an angle that is greater than 0° and less than the angle θ21. For example, the angle θ22 may be substantially the same as the angle θ12. The wall surface HP22 may extend in the −X direction when viewed in the Y-axis direction. The sloped portion TP2A may have substantially the same shape as the sloped portion TP1A. Specifically, for example, the sloped portion TP1A and the sloped portion TP2A may be provided symmetrically with respect to a plane that goes through the nozzle N and is parallel to a Y-Z plane.

As illustrated in FIG. 7, the sloped portion TP2B is provided between the wall surface HKb2 and the wall surface HC2 in the pressure compartment substrate 3. The sloped portion TP2B has a wall surface HP24. When viewed in the Y-axis direction, the wall surface HP24 extends in a W23 direction and is continuous from the wall surface HKb2 to the wall surface HC2. The W23 direction is a direction between the +X direction and the −Z direction. Specifically, the W23 direction is a direction obtained by rotating the +X direction counterclockwise by an angle θ23 when viewed in the +Y direction. The angle θ23 is an angle that is greater than 0° and less than 90°, preferably, greater than 30° and less than 60°. For example, the angle θ23 may be substantially the same as the angle θ21. For example, the angle θ23 may be substantially the same as the angle θ13. The sloped portion TP2B may have substantially the same shape as the sloped portion TP1B. Specifically, for example, the sloped portion TP1B and the sloped portion TP2B may be provided symmetrically with respect to a plane that goes through the nozzle N and is parallel to a Y-Z plane.

In the present embodiment, the nozzle N is provided substantially at the center of the nozzle flow passage RN. For example, the distance from the nozzle N to the wall surface HRb1 in the X-axis direction may be substantially the same as the distance from the nozzle N to the wall surface HRb2 in the X-axis direction. The concept of "substantially at the center" herein includes not only a case of being exactly at the center but also a case of being able to be deemed as being at the center, with a margin of error taken into consideration.

4. Referential Example

For the purpose of making the effects of the present embodiment clear, with reference to FIG. 8, a liquid ejecting head 1Z according to a referential example will now be explained. The liquid ejecting head 1Z has the same structure as that of the liquid ejecting head 1 according to the present embodiment, except that the liquid ejecting head 1Z includes a pressure compartment substrate 3Z instead of the pressure compartment substrate 3. The pressure compartment substrate 3Z has the same structure as that of the pressure compartment substrate 3 according to the present embodiment, except that the sloped portions TP1A, TP1B, TP2A, and TP2B are not provided in the pressure compartment substrate 3Z. The liquid ejecting head 1Z includes a circulation flow passage RJZ. The circulation flow passage RJZ is different from the circulation flow passage RJ according to the present embodiment in that a pressure compartment CB1Z is provided instead of the pressure compartment CB1 and that a pressure compartment CB2Z is provided instead of the pressure compartment CB2.

Figure 8:
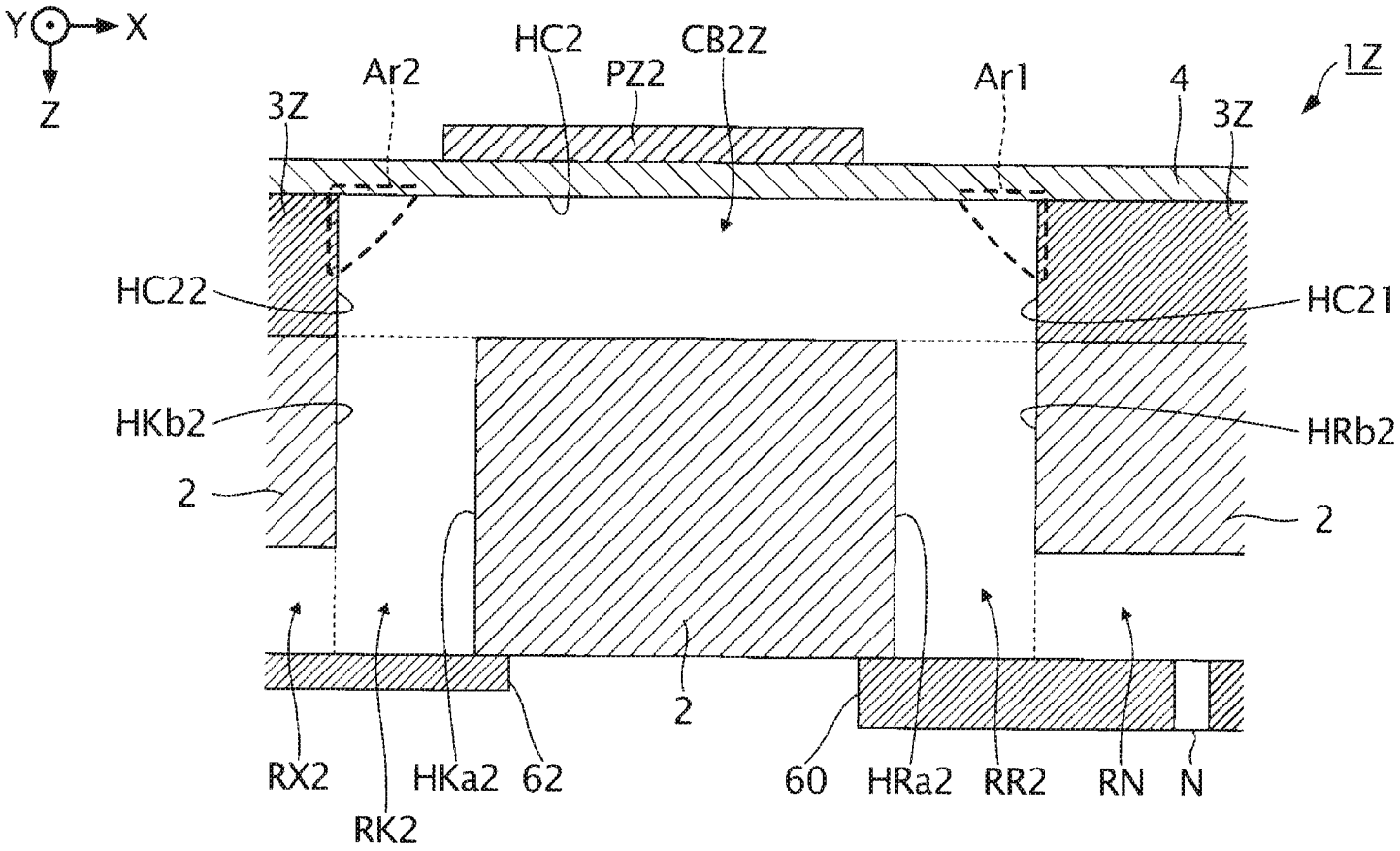
FIG. 8 is a sectional view of an example of the structure of a liquid ejecting head 1Z according to a referential example.

FIG. 8 is a sectional view of the nozzle flow passage RN, the communication flow passage RR2, the pressure compartment CB2Z, the communication flow passage RK2, and the communication flow passage RX2 among those constituting the circulation flow passage RJZ of the liquid ejecting head 1Z according to the referential example. As illustrated in FIG. 8, when viewed in the Y-axis direction, the pressure compartment CB2Z includes two wall surfaces HC21 and HC22 that constitute the pressure compartment CB2Z and extend in the Z-axis direction. The wall surface HC21, which is one of the two wall surfaces that constitute the pressure compartment CB2Z and extend in the Z-axis direction, is a +X wall surface and is continuous from the wall surface HRb2 to the wall surface HC2. The wall surface HC22, which is the other of the two wall surfaces that constitute the pressure compartment CB2Z and extend in the Z-axis direction, is a −X wall surface and is continuous from the wall surface HKb2 to the wall surface HC2.

When ink flows from the supply flow passage RA1 to the discharge flow passage RA2 through the circulation flow passage RJZ in the liquid ejecting head 1Z according to the referential example, the speed of the flow of the ink decreases at a boundary area An where the wall surface HC2 and the wall surface HC21 meet with each other and at a boundary area Ar2 where the wall surface HC2 and the wall surface HC22 meet with each other, and the stagnation of the ink occurs. This increases the possibility that an air bubble formed inside the circulation flow passage RJZ will stay at the area Ar1/Ar2. In the liquid ejecting head 1Z according to the referential example, when the piezoelectric element PZ2 is driven by the drive signal Com2 in an attempt to eject ink inside the pressure compartment CB2Z from the nozzle N, pressure for forcing the ink out by the piezoelectric element PZ2 might be absorbed by an air bubble staying at the area An or at the area Ar2 of the pressure compartment CB2Z, and so-called ejection abnormality, a phenomenon of having difficulty in ejecting the ink from the nozzle N, might occur. If such ejection abnormality occurs, the quality of an image that is formed on the medium PP becomes lower. Similarly, in the liquid ejecting head 1Z according to the referential example, pressure for forcing ink out by the piezoelectric element PZ1 might be absorbed by an air bubble staying inside the pressure compartment CB1Z, resulting in having difficulty in ejecting the ink from the nozzle N.

To provide a solution to this issue, in the liquid ejecting head 1 according to the present embodiment, the sloped portion TP2A and the sloped portion TP2B are provided in the pressure compartment CB2. Therefore, in the liquid ejecting head 1 according to the present embodiment, as compared with the liquid ejecting head 1Z, it is possible to decrease the possibility that an air bubble will stay inside the pressure compartment CB2. In addition, in the liquid ejecting head 1 according to the present embodiment, unlike the liquid ejecting head 1Z, the sloped portion TP1A and the sloped portion TP1B are provided in the pressure compartment CB1. Therefore, in the liquid ejecting head 1 according to the present embodiment, as compared with the liquid ejecting head 1Z, it is possible to decrease the possibility that an air bubble will stay inside the pressure compartment CB1. Therefore, in the liquid ejecting head 1 according to the present embodiment, as compared with the liquid ejecting head 1Z, it is possible to decrease the possibility of occurrence of ejection abnormality due to an air bubble. For this reason, in the liquid ejecting head 1 according to the present embodiment, as compared with the liquid ejecting head 1Z, it is possible to form an image with higher quality on the medium PP.

5. Summary of Exemplary Embodiment

As explained above, the liquid ejecting head 1 according to the present embodiment includes: the pressure compartment CB1 that extends in the −X direction and applies pressure to ink; the pressure compartment CB2 that extends in the −X direction and applies pressure to ink; the nozzle flow passage RN that extends in the −X direction and is in communication with the nozzle N from which ink is ejected; the communication flow passage RR1 that extends in the −Z direction intersecting with the −X direction and provides communication between the pressure compartment CB1 and the nozzle flow passage RN; the communication flow passage RR2 that extends in the −Z direction and provides communication between the pressure compartment CB2 and the nozzle flow passage RN; the supply flow passage RA1 from which ink is supplied to the pressure compartment CB1; and the discharge flow passage RA2 to which ink is discharged from the pressure compartment CB2; wherein wall surfaces of the pressure compartment CB2 include the wall surface HC2 that extends in the −X direction and is most distant from the nozzle N in the −Z direction, wall surfaces of the communication flow passage RR2 include the wall surface HRa2 that extends in the −Z direction and is most distant from the nozzle N in the −X direction and the wall surface HRb2 that is opposite of the wall surface HRa2 in the −X direction, the sloped portion TP2A is provided between the wall surface HC2 and the wall surface HRb2, and the sloped portion TP2A includes the wall surface HP21 that extends in the W21 direction between the −X direction and the −Z direction. That is, in the liquid ejecting head 1 according to the present embodiment, since the sloped portion TP2A is provided in the pressure compartment CB2, as compared with an embodiment in which the sloped portion TP2A is not provided in the pressure compartment CB2, it is possible to make the flow of ink from the communication flow passage RR2 toward the pressure compartment CB2 and the flow of ink from the pressure compartment CB2 toward the communication flow passage RR2 more smooth. Therefore, in the liquid ejecting head 1 according to the present embodiment, as compared with an embodiment in which the sloped portion TP2A is not provided in the pressure compartment CB2, it is possible to decrease the possibility that an air bubble will stay inside the communication flow passage RR2 and the possibility that an air bubble will stay inside the pressure compartment CB2. For this reason, in the liquid ejecting head 1 according to the present embodiment, as compared with an embodiment in which the sloped portion TP2A is not provided in the pressure compartment CB2, it is possible to decrease the possibility of occurrence of ejection abnormality due to an air bubble. Moreover, in the liquid ejecting head 1 according to the present embodiment, since the pressure compartment CB1 and the pressure compartment CB2 are in communication with each other through the communication flow passage RR1, the nozzle flow passage RN, and the communication flow passage RR2, it is possible to produce the flow of ink between the pressure compartment CB1 and the pressure compartment CB2. Therefore, in the liquid ejecting head 1 according to the present embodiment, as compared with an embodiment in which the pressure compartment CB1 and the pressure compartment CB2 are not in communication with each other, it is possible to decrease the possibility that an air bubble will stay inside the nozzle flow passage RN, etc. For this reason, in the liquid ejecting head 1 according to the present embodiment, as compared with an embodiment in which the pressure compartment CB1 and the pressure compartment CB2 are not in communication with each other, it is possible to decrease the possibility of occurrence of ejection abnormality due to an air bubble. In the present embodiment, the pressure compartment CB1 is an example of a "first pressure compartment", the pressure compartment CB2 is an example of a "second pressure compartment", the communication flow passage RR1 is an example of a "first communication flow passage", the communication flow passage RR2 is an example of a "second communication flow passage", the wall surface HC2 is an example of a "first wall surface", the wall surface HRa2 is an example of a "second wall surface", the wall surface HRb2 is an example of a "third wall surface", the sloped portion TP2A is an example of a "first sloped portion", the wall surface HP21 is an example of a "first constituting surface", ink is an example of "liquid", the −X direction is an example of a "first direction", the −Z direction is an example of a "second direction", and the W21 direction is an example of a "third direction".

The liquid ejecting head 1 according to the present embodiment further includes: the communication flow passage RK2 that extends in the −Z direction and provides communication between the pressure compartment CB2 and the discharge flow passage RA2; wherein wall surfaces of the communication flow passage RK2 include the wall surface HKb2 that extends in the −Z direction and is most distant from the nozzle N in the −X direction, the sloped portion TP2B is provided between the wall surface HC2 and the wall surface HKb2, and the sloped portion TP2B includes the wall surface HP24 that extends in the W23 direction between the +X direction and the −Z direction. That is, in the liquid ejecting head 1 according to the present embodiment, since the sloped portion TP2B is provided in the pressure compartment CB2, as compared with an embodiment in which the sloped portion TP2B is not provided in the pressure compartment CB2, it is possible to make the flow of ink from the communication flow passage RK2 toward the pressure compartment CB2 and the flow of ink from the pressure compartment CB2 toward the communication flow passage RK2 more smooth. Therefore, in the liquid ejecting head 1 according to the present embodiment, as compared with an embodiment in which the sloped portion TP2B is not provided in the pressure compartment CB2, it is possible to decrease the possibility that an air bubble will stay inside the communication flow passage RK2 and the possibility that an air bubble will stay inside the pressure compartment CB2. For this reason, in the liquid ejecting head 1 according to the present embodiment, as compared with an embodiment in which the sloped portion TP2B is not provided in the pressure compartment CB2, it is possible to decrease the possibility of occurrence of ejection abnormality due to an air bubble. In the present embodiment, the communication flow passage RK2 is an example of a "third communication flow passage", the wall surface HKb2 is an example of a "fourth wall surface", the sloped portion TP2B is an example of a "second sloped portion", the wall surface HP24 is an example of a "second constituting surface", the +X direction is an example of a "fourth direction", and the W23 direction is an example of a "fifth direction".

In the liquid ejecting head 1 according to the present embodiment, the angle θ21 formed by the −X direction and the W21 direction may be substantially the same as the angle θ23 formed by the +X direction and the W23 direction. As compared with a structure in which the angle θ21 and the angle θ23 are different from each other, the present embodiment makes it easier to manufacture the liquid ejecting head 1.

In the liquid ejecting head 1 according to the present embodiment, the sloped portion TP2A includes the wall surface HP22 that extends in the W22 direction between the −X direction and the W21 direction. In this case, the wall surface HP22 may be provided between the wall surface HP21 and the wall surface HRb2. In addition, in this case, the wall surface HP23 extending in the W21 direction may be provided between the wall surface HP22 and the wall surface HRb2. That is, in the liquid ejecting head 1 according to the present embodiment, since the sloped portion TP2A has the wall surface HP22, as compared with an embodiment in which the sloped portion TP2A does not have the wall surface HP22, it is possible to make the flow of ink from the communication flow passage RR2 toward the pressure compartment CB2 and the flow of ink from the pressure compartment CB2 toward the communication flow passage RR2 more smooth. Therefore, in the liquid ejecting head 1 according to the present embodiment, as compared with an embodiment in which the sloped portion TP2A does not have the wall surface HP22, it is possible to decrease the possibility that an air bubble will stay inside the communication flow passage RR2 and the possibility that an air bubble will stay inside the pressure compartment CB2. In particular, the sloped portion TP2A is a structure element that changes the direction of the flow of ink from the +X direction to the +Z direction when ink is ejected from the nozzle N and changes the direction of the flow of ink from the −Z direction to the −X direction when ink is circulated through the circulation flow passage RJ without ejecting the ink from the nozzle N. In the present embodiment, since the sloped portion TP2A has the wall surface HP22 extending in the W22 direction, the angle of the slope of which with respect to the X-axis direction is comparatively small, it is possible to change the direction of the flow of ink from the +X direction to the +Z direction smoothly when ink is ejected from the nozzle N. Moreover, in the present embodiment, since the sloped portion TP2A has the wall surface HP23 extending in the W21 direction, the angle of the slope of which with respect to the X-axis direction is comparatively large, it is possible to change the direction of the flow of ink from the −Z direction to the −X direction smoothly when ink is circulated through the circulation flow passage RJ without ejecting the ink from the nozzle N. In the present embodiment, the wall surface HP22 is an example of a "third constituting surface", and the W22 direction is an example of a "sixth direction".

In the liquid ejecting head 1 according to the present embodiment, wall surfaces of the pressure compartment CB1 include the wall surface HC1 that extends in the −X direction and is most distant from the nozzle N in the −Z direction, wall surfaces of the communication flow passage RR1 include the wall surface HRa1 that extends in the −Z direction and is most distant from the nozzle N in the +X direction and the wall surface HRb1 that is opposite of the wall surface HRa1 in the −X direction, the sloped portion TP1A is provided between the wall surface HC1 and the wall surface HRb1, and the sloped portion TP1A includes the wall surface HP11 that extends in the W11 direction between the −Z direction and the +X direction. That is, in the liquid ejecting head 1 according to the present embodiment, since the sloped portion TP1A is provided in the pressure compartment CB1, as compared with an embodiment in which the sloped portion TP1A is not provided in the pressure compartment CB1, it is possible to make the flow of ink from the communication flow passage RR1 toward the pressure compartment CB1 and the flow of ink from the pressure compartment CB1 toward the communication flow passage RR1 more smooth. Therefore, in the liquid ejecting head 1 according to the present embodiment, as compared with an embodiment in which the sloped portion TP1A is not provided in the pressure compartment CB1, it is possible to decrease the possibility that an air bubble will stay inside the communication flow passage RR1 and the possibility that an air bubble will stay inside the pressure compartment CB1. For this reason, in the liquid ejecting head 1 according to the present embodiment, as compared with an embodiment in which the sloped portion TP1A is not provided in the pressure compartment CB1, it is possible to decrease the possibility of occurrence of ejection abnormality due to an air bubble. In the present embodiment, the wall surface HC1 is an example of a "fifth wall surface", the wall surface HRal is an example of a "sixth wall surface", the wall surface HRb1 is an example of a "seventh wall surface", the sloped portion TP1A is an example of a "third sloped portion", the wall surface HP11 is an example of a "fourth constituting surface", and the W11 direction is another example of a "fifth direction".

In the liquid ejecting head 1 according to the present embodiment, the sloped portion TP2A and the sloped portion TP1A may have substantially the same shape. In the present embodiment, if the sloped portion TP2A and the sloped portion TP1A have substantially the same shape, it becomes easier to manufacture the liquid ejecting head 1, as compared with a structure in which the shape of the sloped portion TP2A is different from the shape of the sloped portion TP1A. Moreover, in the present embodiment, if the sloped portion TP2A and the sloped portion TP1A have substantially the same shape, it is possible to make the shape of the ink flow passage leading from the pressure compartment CB1 to the nozzle N through the communication flow passage RR1 and the nozzle flow passage RN substantially the same as the shape of the ink flow passage leading from the pressure compartment CB2 to the nozzle N through the communication flow passage RR2 and the nozzle flow passage RN. Therefore, in the present embodiment, if the sloped portion TP2A and the sloped portion TP1A have substantially the same shape, it is possible to make the control for ejecting ink contained inside the pressure compartment CB1 from the nozzle N and the control for ejecting ink contained inside the pressure compartment CB2 from the nozzle N more simple, as compared with a structure in which the shape of the sloped portion TP2A is different from the shape of the sloped portion TP1A.

The liquid ejecting head 1 according to the present embodiment further includes: the communication flow passage RK1 that extends in the −Z direction and provides communication between the pressure compartment CB1 and the supply flow passage RA1; wherein wall surfaces of the communication flow passage RK1 include the wall surface HKb1 that extends in the −Z direction and is most distant from the nozzle N in the +X direction, the sloped portion TP1B is provided between the wall surface HC1 and the wall surface HKb1, and the sloped portion TP1B includes the wall surface HP14 that extends in the W13 direction. That is, in the liquid ejecting head 1 according to the present embodiment, since the sloped portion TP1B is provided in the pressure compartment CB1, as compared with an embodiment in which the sloped portion TP1B is not provided in the pressure compartment CB1, it is possible to make the flow of ink from the communication flow passage RK1 toward the pressure compartment CB1 and the flow of ink from the pressure compartment CB1 toward the communication flow passage RK1 more smooth. Therefore, in the liquid ejecting head 1 according to the present embodiment, as compared with an embodiment in which the sloped portion TP1B is not provided in the pressure compartment CB1, it is possible to decrease the possibility that an air bubble will stay inside the communication flow passage RK1 and the possibility that an air bubble will stay inside the pressure compartment CB1. For this reason, in the liquid ejecting head 1 according to the present embodiment, as compared with an embodiment in which the sloped portion TP1B is not provided in the pressure compartment CB1, it is possible to decrease the possibility of occurrence of ejection abnormality due to an air bubble. In the present embodiment, the communication flow passage RK1 is an example of a "fourth communication flow passage", the wall surface HKb1 is an example of an "eighth wall surface", the sloped portion TP1B is an example of a "fourth sloped portion", the wall surface HP14 is an example of a "fifth constituting surface", and the W13 direction is another example of a "third direction".

The liquid ejecting head 1 according to the present embodiment further includes: the pressure compartment substrate 3 in which the pressure compartment CB1 and the pressure compartment CB2 are provided; the communication plate 2 in which the nozzle flow passage RN, the communication flow passage RR1, the communication flow passage RR2, the supply flow passage RA1, and the discharge flow passage RA2 are provided; and the nozzle substrate 60 in which the nozzle N is provided. Therefore, the present embodiment makes it possible to manufacture the pressure compartment CB1, the pressure compartment CB2, the nozzle flow passage RN, the communication flow passage RR1, the communication flow passage RR2, the supply flow passage RA1, the discharge flow passage RA2, and the nozzle N by using a semiconductor manufacturing technology. For this reason, the present embodiment makes it possible to realize the microfabrication and high density of the pressure compartment CB1, the pressure compartment CB2, the nozzle flow passage RN, the communication flow passage RR1, the communication flow passage RR2, the supply flow passage RA1, the discharge flow passage RA2, and the nozzle N.

In the liquid ejecting head 1 according to the present embodiment, the sloped portion TP2A is provided in the pressure compartment substrate 3. Therefore, the present embodiment makes it possible to manufacture the sloped portion TP2A by using a semiconductor manufacturing technology. For this reason, the present embodiment makes it possible to realize the microfabrication and high density of the sloped portion TP2A.

In the liquid ejecting head 1 according to the present embodiment, the nozzle N is in communication with the nozzle flow passage RN substantially at the center of the nozzle flow passage RN. Therefore, the present embodiment makes it possible to make the shape of the ink flow passage leading from the pressure compartment CB1 to the nozzle N through the communication flow passage RR1 and the nozzle flow passage RN substantially the same as the shape of the ink flow passage leading from the pressure compartment CB2 to the nozzle N through the communication flow passage RR2 and the nozzle flow passage RN. For this reason, for example, the present embodiment makes it possible to make the control for ejecting ink contained inside the pressure compartment CB1 from the nozzle N and the control for ejecting ink contained inside the pressure compartment CB2 from the nozzle N more simple, as compared with an embodiment in which the nozzle N is in communication with the nozzle flow passage RN at a different position that is not substantially the center of the nozzle flow passage RN.

The liquid ejecting head 1 according to the present embodiment further includes: the piezoelectric element PZ1 that applies pressure to ink inside the pressure compartment CB1 in response to supply of the drive signal Com1; and the piezoelectric element PZ2 that applies pressure to ink inside the pressure compartment CB2 in response to supply of the drive signal Com2. For this reason, as compared with an embodiment in which the piezoelectric element PZq that applies pressure to ink inside a single pressure compartment CBq only is provided, it is possible to increase the amount of ink ejected from the nozzle N. In the present embodiment, the piezoelectric element PZ1 is an example of a "first element", the piezoelectric element PZ2 is an example of a "second element", the drive signal Com1 is an example of a "first drive signal", and the drive signal Com2 is an example of a "second drive signal".

In the liquid ejecting head 1 according to the present embodiment, a waveform of the drive signal Com1 is substantially the same as a waveform of the drive signal Com2. Therefore, the present embodiment makes it possible to make the control for ejecting ink contained inside the pressure compartment CB1 from the nozzle N and the control for ejecting ink contained inside the pressure compartment CB2 from the nozzle N more simple, as compared with an embodiment in which the waveform of the drive signal Com1 is different from the waveform of the drive signal Com2.

B. Variation Examples

The embodiment described as examples above can be modified in various ways. Some specific examples of modification are described below. Two or more variation examples selected arbitrarily from the description below may be combined as long as they are not contradictory to each other or one another.

First Variation Example

In the foregoing embodiment, as illustrated in FIG. 4, it is explained as an example that the shape of the pressure compartment CBq is rectangular when viewed in the Z-axis direction. However, the scope of the present disclosure is not limited to such an example. The pressure compartment CBq may have any shape when viewed in the Z-axis direction. For example, the pressure compartment CBq may have a shape of a parallelogram or a trapezoid when viewed in the Z-axis direction. The shape of the circulation flow passage RJ when viewed in the Z-axis direction is also not limited to the shape illustrated in FIG. 4. The circulation flow passage RJ may have any shape when viewed in the Z-axis direction.

Figure 9:
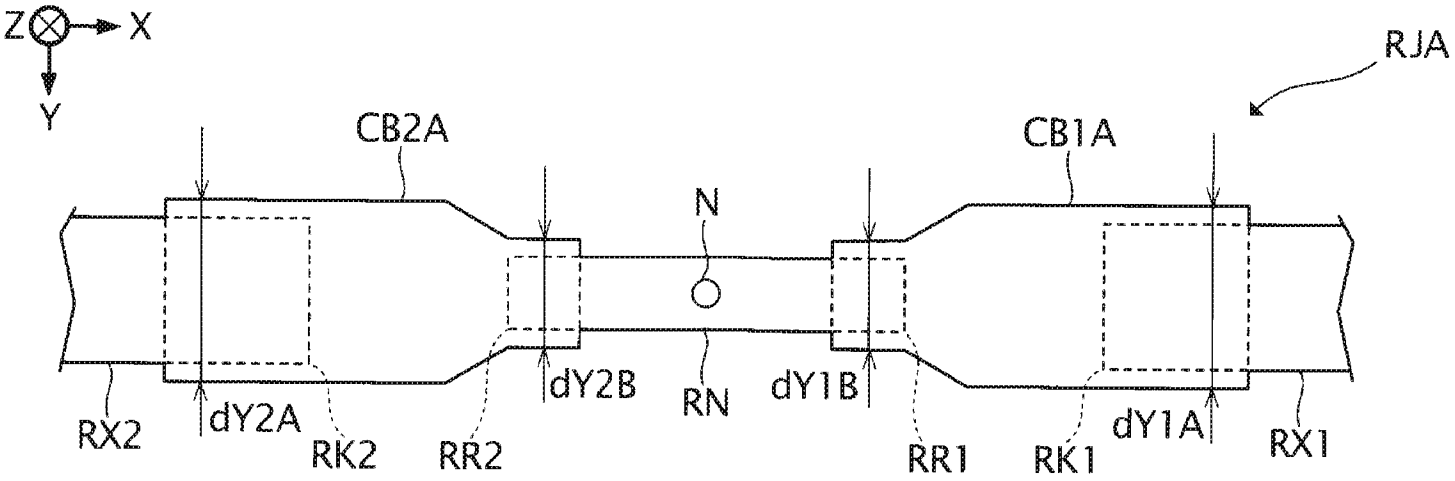
FIG. 9 is a plan view of an example of the structure of a circulation flow passage RJA according to a first variation example.

FIG. 9 is a plan view of a circulation flow passage RJA according to the present variation example when viewed in the Z-axis direction. As illustrated in FIG. 9, in the present variation example, the circulation flow passage RJA is different from the circulation flow passage RJ according to the foregoing embodiment in that a pressure compartment CB1A is provided instead of the pressure compartment CB1 and that a pressure compartment CB2A is provided instead of the pressure compartment CB2. The pressure compartment CB1A has such a structure that its Y-directional width dY1A at the −Z side of the communication flow passage RK1 is greater than its Y-directional width dY1B at the −Z side of the communication flow passage RR1. The pressure compartment CB2A has such a structure that its Y-directional width dY2A at the −Z side of the communication flow passage RK2 is greater than its Y-directional width dY2B at the −Z side of the communication flow passage RR2. The width dY2A may be substantially the same as the width dY1A. The width dY2B may be substantially the same as the width dY1B.

Since the Y-directional width dYqB of the pressure compartment CBq at a position near the communication flow passage RRq is less than the Y-directional width dYqA of the pressure compartment CBq at a position near the communication flow passage RKq, the present variation example makes it possible to make the speed of the flow of ink at the communication flow passage RRq higher than the speed of the flow of ink at the communication flow passage RKq. Because of the faster flow at the communication flow passage RRq, the present variation example makes it possible to decrease the possibility that an air bubble will stay inside the passage leading from the pressure compartment CBq to the nozzle N through the communication flow passage RRq and the nozzle flow passage RN. For this reason, the present variation example makes it possible to decrease the possibility of occurrence of ejection abnormality due to an air bubble.

Second Variation Example

In the foregoing embodiment and the first variation example, the serial-type liquid ejecting apparatus 100 that reciprocates the endless belt 922 with the liquid ejecting heads 1 in the Y-axis direction is explained as examples. However, the scope of the present disclosure is not limited to these examples. The liquid ejecting apparatus may be a so-called line-type liquid ejecting apparatus in which the plural nozzles N are arranged throughout the entire width of the medium PP.

Figure 10:
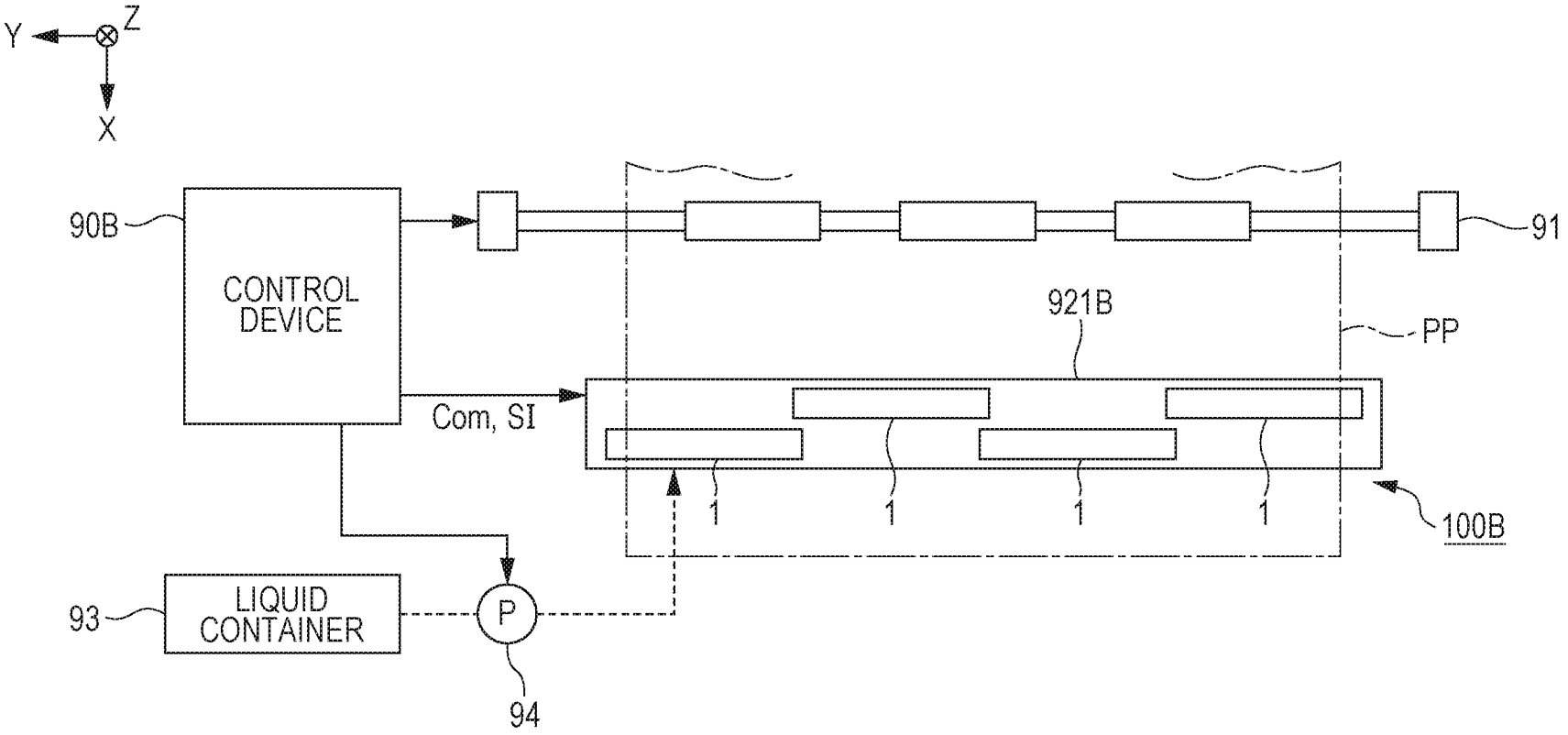
FIG. 10 is a diagram that illustrates an example of the structure of a liquid ejecting apparatus 100B according to a second variation example.

FIG. 10 is a diagram that illustrates an example of the structure of a liquid ejecting apparatus 100B according to the present variation example. The liquid ejecting apparatus 100B is different from the liquid ejecting apparatus 100 according to the foregoing embodiment in that the liquid ejecting apparatus 100B includes a control device 90B instead of the control device 90, includes a housing case 921B instead of the housing case 921, and does not include the endless belt 922. The control device 90B is different from the control device 90 in that the control device 90B does not output any signal for controlling the endless belt 922. The plurality of liquid ejecting heads 1 whose length direction is oriented in the Y-axis direction is provided inside the housing case 921B in such a way as to be arranged throughout the entire width of the medium PP. Instead of the liquid ejecting heads 1, liquid ejecting heads 1A or liquid ejecting heads 1B may be provided inside the housing case 921B.

Third Variation Example

In the foregoing embodiment and the first and second variation examples, the piezoelectric element PZq that converts electric energy into motion energy is described for showing some examples of an energy conversion element that applies pressure to the inside of the pressure compartment CB. However, the scope of the present disclosure is not limited to these examples. For example, a heat generation element that converts electric energy into thermal energy and generates air bubbles inside the pressure compartment CB by heating to cause changes in pressure inside the pressure compartment CB may be used as the energy conversion element that applies pressure to the inside of the pressure compartment CB. The heat generation element may be, for example, an element in which a heater generates heat by receiving a supply of the drive signal Com.

Fourth Variation Example

The liquid ejecting apparatus disclosed as examples in the foregoing embodiment and the first, second, and third variation examples can be applied to various kinds of equipment such as facsimiles and copiers, etc. in addition to print-only machines. The scope of application and use of the liquid ejecting apparatus according to the present disclosure is not limited to printing. For example, a liquid ejecting apparatus that ejects a colorant solution can be used as an apparatus for manufacturing a color filter of a liquid crystal display device. A liquid ejecting apparatus that ejects a solution of a conductive material can be used as a manufacturing apparatus for forming wiring lines and electrodes of a wiring substrate.

What is claimed is:

1. A liquid ejecting head, comprising:

a first pressure compartment that extends in a first direction and applies pressure to liquid;

a second pressure compartment that extends in the first direction and applies pressure to liquid;

a nozzle flow passage that extends in the first direction and is in communication with a nozzle from which liquid is ejected;

a first communication flow passage that extends in a second direction intersecting with the first direction and provides communication between the first pressure compartment and the nozzle flow passage;

a second communication flow passage that extends in the second direction and provides communication between the second pressure compartment and the nozzle flow passage;

a third communication flow passage that extends in the second direction and provides communication between the second pressure compartment and the discharge flow passage;

a supply flow passage from which liquid is supplied to the first pressure compartment; and a discharge flow passage to which liquid is discharged from the second pressure compartment; wherein wall surfaces of the second pressure compartment include a first wall surface that extends in the first direction and is most distant from the nozzle in the second direction, wall surfaces of the second communication flow passage include a second wall surface that extends in the second direction and is most distant from the nozzle in the first direction and a third wall surface that is opposite of the second wall surface in the first direction, wall surfaces of the third communication flow passage include a fourth wall surface that extends in the second direction and is most distant from the nozzle in the first direction, a first sloped portion is provided between the first wall surface and the third wall surface, the first sloped portion including a first constituting surface that extends in a third direction between the first direction and the second direction, a second sloped portion between the first wall surface and the fourth wall surface, the second sloped portion including a second constituting surface that extends in a fifth direction between a fourth direction, which is the opposite of the first direction, and the second direction, the first portion and the second sloped portion have asymmetric shape.

2. The liquid ejecting head according to claim 1, wherein an angle formed by the first direction and the third direction is substantially the same as an angle formed by the fourth direction and the fifth direction.

3. The liquid ejecting head according to claim 1, wherein the first sloped portion includes a third constituting surface that extends in a sixth direction between the first direction and the third direction.

4. The liquid ejecting head according to claim 3, wherein the third constituting surface is provided between the first constituting surface and the third wall surface.

5. The liquid ejecting head according to claim 1, wherein the first sloped portion includes a third constituting surface that extends in the first direction.

6. The liquid ejecting head according to claim 1, wherein wall surfaces of the first pressure compartment include a fifth wall surface that extends in the first direction and is most distant from the nozzle in the second direction, wall surfaces of the first communication flow passage include a sixth wall surface that extends in the second direction and is most distant from the nozzle in a fourth direction, which is opposite of the first direction, and a seventh wall surface that is opposite of the sixth wall surface in the first direction, a third sloped portion is provided between the fifth wall surface and the seventh wall surface, and the third sloped portion includes a fourth constituting surface that extends in a fifth direction between the second direction and the fourth direction.

7. The liquid ejecting head according to claim 6, wherein the first sloped portion and the third sloped portion have substantially the same shape.

8. The liquid ejecting head according to claim 6, further comprising:

a fourth communication flow passage that extends in the second direction and provides communication between the first pressure compartment and the supply flow passage; wherein wall surfaces of the fourth communication flow passage include an eighth wall surface that extends in the second direction and is most distant from the nozzle in the fourth direction, a fourth sloped portion is provided between the fifth wall surface and the eighth wall surface, and the fourth sloped portion includes a fifth constituting surface that extends in the third direction.

9. The liquid ejecting head according to claim 1, further comprising:

a pressure compartment substrate in which the first pressure compartment and the second pressure compartment are provided;

a communication plate in which the nozzle flow passage, the first communication flow passage, the second communication flow passage, the supply flow passage, and the discharge flow passage are provided; and a nozzle substrate in which the nozzle is provided.

10. The liquid ejecting head according to claim 9, wherein the first sloped portion is provided in the pressure compartment substrate.

11. The liquid ejecting head according to claim 1, wherein the nozzle is in communication with the nozzle flow passage substantially at the center of the nozzle flow passage.

12. The liquid ejecting head according to claim 1, further comprising:

a first element that applies pressure to liquid inside the first pressure compartment in response to supply of a first drive signal; and a second element that applies pressure to liquid inside the second pressure compartment in response to supply of a second drive signal.

13. The liquid ejecting head according to claim 12, wherein a waveform of the first drive signal is substantially the same as a waveform of the second drive signal.

14. A liquid ejecting apparatus, comprising:

a first pressure compartment that extends in a first direction and applies pressure to liquid;

a second pressure compartment that extends in the first direction and applies pressure to liquid;

a nozzle flow passage that extends in the first direction and is in communication with a nozzle from which liquid is ejected;

a first communication flow passage that extends in a second direction intersecting with the first direction and provides communication between the first pressure compartment and the nozzle flow passage;

a second communication flow passage that extends in the second direction and provides communication between the second pressure compartment and the nozzle flow passage;

a third communication flow passage that extends in the second direction and provides communication between the second pressure compartment and the discharge flow passage;

a supply flow passage from which liquid is supplied to the first pressure compartment; and a discharge flow passage to which liquid is discharged from the second pressure compartment; wherein wall surfaces of the second pressure compartment include a first wall surface that extends in the first direction and is most distant from the nozzle in the second direction, wall surfaces of the second communication flow passage include a second wall surface that extends in the second direction and is most distant from the nozzle in the first direction and a third wall surface that is opposite of the second wall surface in the first direction, wall surfaces of the third communication flow passage include a fourth wall surface that extends in the second direction and is most distant from the nozzle in the first direction, a first sloped portion is provided between the first wall surface and the third wall surface, the first sloped portion including a first constituting surface that extends in a third direction between the first direction and the second direction, a second sloped portion is provided between the first wall surface and the fourth wall surface, the second sloped portion including a second constituting surface that extends in a fifth direction between a fourth direction, which is opposite of the first direction, and the second direction, and the first sloped portion and the second sloped portion have asymmetric shape.

15. A liquid ejecting head, comprising:

a first pressure compartment that extends in a first direction and applies pressure to liquid;

a second pressure compartment that extends in the first direction and applies pressure to liquid;

a nozzle flow passage that extends in the first direction and is in communication with a nozzle from which liquid is ejected;

a first communication flow passage that extends in a second direction intersecting with the first direction and provides communication between the first pressure compartment and the nozzle flow passage;

a second communication flow passage that extends in the second direction and provides communication between the second pressure compartment and the nozzle flow passage;

a third communication flow passage that extends in the second direction and provides communication between the second pressure compartment and the discharge flow passage;

a supply flow passage from which liquid is supplied to the first pressure compartment; and a discharge flow passage to which liquid is discharged from the second pressure compartment; wherein wall surfaces of the second pressure compartment include a first wall surface that extends in the first direction and is most distant from the nozzle in the second direction, wall surfaces of the second communication flow passage include a second wall surface that extends in the second direction and is most distant from the nozzle in the first direction and a third wall surface that is opposite of the second wall surface in the first direction, wall surfaces of the third communication flow passage include a fourth wall surface that extends in the second direction and is most distant from the nozzle in the first direction, a first sloped portion is provided between the first wall surface and the third wall surface, the first sloped portion including a first constituting surface that extends in a third direction between the first direction and the second direction, a second sloped portion is provided between the first wall surface and the fourth wall surface, the second sloped portion including a second constituting surface that extends in a fifth direction between a fourth direction, which is opposite of the first direction, and the second direction, the first sloped portion includes a third constituting surface that extends in a sixth direction between the first direction and the third direction.

16. The liquid ejecting head according to claim 15, wherein an angle formed by the first direction and the third direction is substantially the same as an angle formed by the fourth direction and the fifth direction.

17. The liquid ejecting head according to claim 15, wherein the third constituting surface is provided between the first constituting surface and the third wall surface.

* * * * *